US012808537B2

(12) United States Patent
Fech

(10) Patent No.: US 12,808,537 B2
(45) Date of Patent: Nov. 24, 2026

(54) FURNACE, SYSTEM, AND METHOD FOR CALIBRATING FLAME CURRENT IN FURNACE

(71) Applicant: Carrier Corporation, Palm Beach Gardens, FL (US)

(72) Inventor: Michael Fech, Huntington, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 369 days.

(21) Appl. No.: 18/627,443

(22) Filed: Apr. 5, 2024

(65) Prior Publication Data

US 2024/0353103 A1 Oct. 24, 2024

Related U.S. Application Data

(60) Provisional application No. 63/496,801, filed on Apr. 18, 2023.

(51) Int. Cl.

| | |
|---|---|
| ***F23N 3/00*** | (2006.01) |
| ***F23N 5/00*** | (2006.01) |
| ***F23N 5/18*** | (2006.01) |

(52) U.S. Cl.

CPC ..... *F23N 5/18* (2013.01); *F23N 3/002* (2013.01); *F23N 5/003* (2013.01); *F23N 2005/181* (2013.01); *F23N 2223/10* (2020.01); *F23N 2225/06* (2020.01); *F23N 2229/12* (2020.01); *F23N 2900/05001* (2013.01); *F23N 2900/05002* (2013.01); *F23N 2900/05003* (2013.01)

(58) Field of Classification Search

CPC . F23N 5/18; F23N 5/003; F23N 3/002; F23N 2229/12; F23N 2225/06; F23N 2223/10; F23N 2005/181; F23N 2900/05001; F23N 2900/05002; F23N 2900/05003

USPC ..... 431/12

See application file for complete search history.

(56) References Cited

U.S. PATENT DOCUMENTS

| | | | |
|---|---|---|---|
| 4,412,809 | A | 11/1983 | Yamaguchi et al. |
| 4,457,692 | A | 7/1984 | Erdman |

(Continued)

FOREIGN PATENT DOCUMENTS

| | | | |
|---|---|---|---|
| CN | 109812982 | A | 5/2019 |
| EP | 2431663 | B1 | 12/2016 |

(Continued)

*Primary Examiner* — Avinash A Savani

(74) *Attorney, Agent, or Firm* — Andrew Goldberg

(57) ABSTRACT

A system and method for calibrating flame current in a furnace is disclosed. The method includes initiating combustion within a combustion chamber by allowing flow of the fuel mixture to the combustion chamber; receiving, from a sensor, signals indicative of a flow rate of the air to the combustion chamber; receiving, from a flame rod sensor, signals indicative of a flame current of the combustion chamber; varying a flow rate of the air to the combustion chamber; receiving, from the flame rod sensor, responsive to varying flow rate of the air to the combustion chamber, signals indicative of a change in the flame current of the combustion chamber; and determining, based on varying flow rate of the air to the combustion chamber, and the change in flame current of the combustion chamber, a correlation between the flow rate of the air, and the flame current of the combustion chamber.

20 Claims, 5 Drawing Sheets

(56) References Cited

U.S. PATENT DOCUMENTS

| | | | | |
|---|---|---|---|---|
| 5,049,063 | A * | 9/1991 | Kishida | F23N 5/123 431/63 |
| 7,241,135 | B2 | 7/2007 | Munsterhuis et al. | |
| 8,157,993 | B1 * | 4/2012 | Pedros | C02F 3/302 210/603 |
| 8,821,154 | B2 | 9/2014 | Yamashita et al. | |
| 9,366,433 | B2 | 6/2016 | Arensmeier | |
| 9,784,449 | B2 | 10/2017 | Margolin | |
| 10,801,722 | B2 | 10/2020 | Arensmeier | |

FOREIGN PATENT DOCUMENTS

| | | | |
|---|---|---|---|
| EP | 3059496 | B1 | 10/2018 |
| JP | S60162122 | A | 8/1985 |
| JP | S6237618 | B2 | 8/1987 |
| JP | S62252825 | A | 11/1987 |
| JP | 2867090 | B2 | 3/1999 |
| JP | 3810174 | B2 | 8/2006 |
| KR | 20160021496 | A | 2/2016 |

* cited by examiner

FURNACE, SYSTEM, AND METHOD FOR CALIBRATING FLAME CURRENT IN FURNACE

CROSS-REFERENCE TO RELATED APPLICATION

This patent application claims the benefit of U.S. Provisional Patent Application No. 63/496,801, filed on Apr. 18, 2023, which is incorporated by reference herein in its entirety.

BACKGROUND

The present invention relates to operation of a furnace, and more particularly, to minimizing harmful emissions during the operation of a furnace.

Conventionally, a flow rate of air in a combustion chamber of a furnace is maintained by setting a predetermined value of pressure and/or flow rate for the air flow. Air flow may play a pivotal role in the efficient combustion of the fuel mixture, which may significantly influence the emission of harmful or noxious gases, such as nitrogen- and carbon-based oxide gases. However, such a methodology may not consider a correlation between the flow rate of air in the combustion chamber, flame current, and temperature stabilization within the combustion chamber. For example, for a set flow rate of air within the combustion chamber, there may be fluctuations in the flame current of the combustion chamber and the temperature stabilization time. This may lead to inefficient combustion, and may increase harmful emissions.

SUMMARY

Disclosed herein is a method for calibrating flame current in a furnace. The method includes initiating, by a controller, combustion within a combustion chamber by allowing flow of the fuel mixture to the combustion chamber. The combustion chamber is configured in the furnace and adapted for burning a fuel mixture including fuel and air. The method further includes receiving, by the controller, from a sensor communicably coupled to it, signals indicative of a flow rate of the air to the combustion chamber. The sensor is configured in the furnace and is configured to generate signals indicative of a flow rate of the fuel mixture into the combustion chamber. For a fixed flow rate of the fuel, the generated signals are indicative of a flow rate of the air. The method further includes receiving, by the controller, from a flame rod sensor communicably coupled to it, signals indicative of a flame current of the combustion chamber. The flame rod sensor is configured in the combustion chamber, and is configured to generate signals indicative of a flame current in the combustion chamber based on ionization of the fuel mixture. The method further includes varying, by the controller, a flow rate of the air to the combustion chamber. The method further includes receiving, by the controller, from the flame rod sensor, responsive to varying of the flow rate of the air to the combustion chamber, signals indicative of a change in the flame current of the combustion chamber. The method further includes determining, by the controller, based on varying of the flow rate of the air to the combustion chamber, and the change in the flame current of the combustion chamber, a correlation between the flow rate of the air to the combustion chamber, flame current of the combustion chamber.

In one or more embodiments, the method further includes varying, by the controller, responsive to the flame current of the combustion chamber reaching a first value, the flow rate of the air to the combustion chamber to a first flow rate lesser than a default flow rate of the air. Responsive to the first flow rate of air, the flame current of the combustion chamber changes to a second value greater than the first value. The method further includes varying, by the controller, responsive to the flame current of the combustion chamber reaching the second value, the flow rate of the air to the combustion chamber to a second flow rate greater than the first flow rate until the flame current of the combustion chamber reaches a third value lesser than the second value.

In one or more embodiments, the second value of flame current of the combustion chamber is a peak value of the flame current for the combustion chamber.

In one or more embodiments, the third value of flame current of the combustion chamber is a predetermined fraction of the second value of flame current of the combustion chamber.

In one or more embodiments, the method further includes varying, by the controller, the flow rate of the air to the combustion chamber, such that the flame current of the combustion chamber is substantially at the third value.

In one or more embodiments, the method further includes operating, by the controller, a valve of an inlet of the furnace to vary the flow rate of the air into the combustion chamber. The inlet is adapted to allow inflow of the air into the furnace, and the inlet is operable by the valve.

In one or more embodiments, the method further includes receiving, by the controller, from a gas sensor communicably coupled to it, signals indicative of a quantity of a first gas in a flue gas from the combustion chamber. The gas sensor is configured downstream of the combustion chamber, and is configured to generate signals indicative of a quantity of the first gas in the flue gas from the combustion chamber. The method further includes varying, by the controller, the flow rate of air to the combustion chamber, such that the quantity of the first gas in the flue gas from the combustion chamber is lesser than a threshold value.

In one or more embodiments, the first gas includes any or a combination of nitrogen-based oxides, carbon-based oxides, and volatile organic compounds.

Further disclosed herein is a system for calibrating flame current in a furnace. The system includes a combustion chamber configured in the furnace. The combustion chamber is adapted for burning a fuel mixture including fuel and air. The system further includes a sensor configured in the furnace. The sensor is configured to generate signals indicative of a flow rate of the fuel mixture into the combustion chamber. For a fixed flow rate of the fuel, the generated signals are indicative of a flow rate of the air. The system further includes a flame rod sensor configured in the combustion chamber. The flame rod sensor is configured to generate signals indicative of a flame current in the combustion chamber. The system further includes a controller communicably coupled to the flame rod sensor and the sensor. The controller is configured to initiate combustion within the combustion chamber by allowing flow of the fuel mixture to the combustion chamber. The controller is further configured to receive, from the sensor, signals indicative of a flow rate of the air to the combustion chamber. The controller is further configured to receive, from the flame rod sensor, signals indicative of a flame current of the combustion chamber. The controller is further configured to vary a flow rate of the air to the combustion chamber. The controller is further configured to receive, from the flame rod sensor, responsive to varying of the flow rate of the air to the combustion chamber, signals indicative of a change in the flame current of the combustion chamber. The controller is further configured to determine, based on varying of the flow rate of the air to the combustion chamber, and the change in the flame current of the combustion chamber, a correlation between the flow rate of the air to the combustion chamber, and the flame current of the combustion chamber.

In one or more embodiments, the controller is further configured to vary, responsive to the flame current of the combustion chamber reaching a first value, the flow rate of the air to the combustion chamber to a first flow rate lesser than a default flow rate of the air. Responsive to the first flow rate of air, the flame current of the combustion chamber changes to a second value greater than the first value. The controller is further configured to vary, responsive to the flame current of the combustion chamber reaching the second value, the flow rate of the air to the combustion chamber to a second flow rate greater than the first flow rate until the flame current of the combustion chamber reaches a third value lesser than the second value.

In one or more embodiments, the second value of flame current of the combustion chamber is a peak value of the flame current for the combustion chamber.

In one or more embodiments, the third value of flame current of the combustion chamber is a predetermined fraction of the second value of flame current of the combustion chamber.

In one or more embodiments, the controller is further configured to vary the flow rate of the air to the combustion chamber, such that the flame current of the combustion chamber is substantially at the third value.

In one or more embodiments, the system further includes an inlet adapted to allow inflow of the air into the furnace. The inlet is operable by a valve communicably coupled to the controller. The controller is configured to operate the valve to vary the flow rate of the air into the combustion chamber.

In one or more embodiments, the system further includes a fan coupled to the inlet. The fan is communicably coupled to the controller. The controller is configured to operate the fan to control the flow rate of the air into the combustion chamber.

In one or more embodiments, the system further includes a gas sensor configured downstream of the combustion chamber, the gas sensor communicably coupled to the controller and configured to generate signals indicative of a quantity of a first gas in a flue gas from the combustion chamber.

In one or more embodiments, the controller is further configured to receive, from the gas sensor, signals indicative of the quantity of the first gas in the flue gas from the combustion chamber. In one or more embodiments, vary the flow rate of air to the combustion chamber, such that the quantity of the first gas in the flue gas from the combustion chamber is lesser than a threshold value.

In one or more embodiments, the first gas includes any or a combination of nitrogen-based oxides, carbon-based oxides, and volatile organic compounds.

In one or more embodiments, the flame rod sensor includes a flame rod. The signals generated by the flame rod include an electric current.

In one or more embodiments, the sensor includes a pressure sensor. The sensor is configured to indicate the flow rate of air in terms of inches of a water column.

Further disclosed herein is a furnace including a combustion chamber. The combustion chamber is adapted for burning a fuel mixture including fuel and air. The furnace further includes a sensor. The sensor is configured to generate signals indicative of a flow rate of the fuel mixture into the combustion chamber. For a fixed flow rate of the fuel, the generated signals are indicative of a flow rate of the air. The furnace further includes a flame rod sensor configured in the combustion chamber. The flame rod sensor is configured to generate signals indicative of a flame current in the combustion chamber. The furnace further includes a controller communicably coupled to the flame rod sensor and the sensor. The controller is configured to initiate combustion within the combustion chamber by allowing flow of the fuel mixture to the combustion chamber. The controller is further configured to receive, from the sensor, signals indicative of a flow rate of the air to the combustion chamber. The controller is further configured to receive, from the flame rod sensor, signals indicative of a flame current of the combustion chamber. The controller is further configured to vary a flow rate of the air to the combustion chamber. The controller is further configured to receive, from the flame rod sensor, responsive to varying of the flow rate of the air to the combustion chamber, signals indicative of a change in the flame current of the combustion chamber. The controller is further configured to determine, based on varying of the flow rate of the air to the combustion chamber, and the change in the flame current of the combustion chamber, a correlation between the flow rate of the air to the combustion chamber, and the flame current of the combustion chamber.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components.

Figure 1:
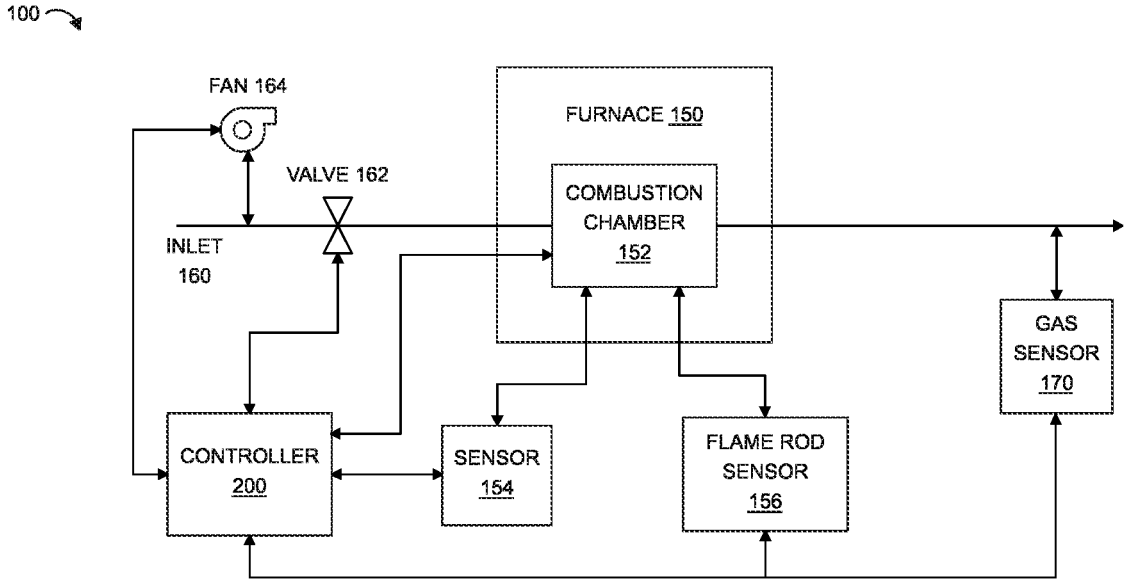
FIG. 1 is a schematic representation of a system for calibrating flame current in a furnace, in accordance with one or more embodiments of the invention.

Referring to FIG. 1, a schematic representation of a system 100 for calibrating flame current in a furnace 150 is shown. In some embodiments, the furnace 150 may be used to provide heat to premises, such as a building. In some other embodiments, the furnace 150 may be used for other applications, such as metallurgical, energy production, etc. The furnace 150 may operate by combusting a fuel mixture. In some embodiments, the fuel mixture may include fuel and air in a stoichiometric ratio. In some embodiments, the fuel may be any or a combination of a solid, a liquid, and a gas. The air may be ambient air. The air may facilitate efficient combustion of the fuel. An appropriate quantity of air may reduce a quantity of noxious emissions that typically are byproducts of the combustion process. The noxious emissions may include nitrogen-based oxides, such as nitrous oxide, nitrogen dioxide, etc., and carbon-based oxides, such as carbon monoxide, carbon dioxide, etc. The noxious emissions may further include volatile organic compounds, which may be present when the fuel is not properly combusted, which, in turn, may be a result of an insufficient quantity of air in the fuel mixture.

The furnace 150 may include a combustion chamber 152 adapted to allow combustion of the fuel mixture. The furnace 150 may further include a sensor 154 configured to measure a rate of flow of the fuel mixture to the combustion chamber 152. In some embodiments, the fuel in the fuel mixture may have a constant flow rate. In such embodiments, the sensor 154 may be configured to measure a rate of flow of the air to the combustion chamber 152.

In some embodiments, the sensor 154 may be a pressure sensor. The pressure sensor may indicate the rate of flow of the fuel mixture entering the combustion chamber by measuring a change in fluid pressure within the combustion chamber 152 or within a flow path for the fuel mixture. In some embodiments, the pressure may be indicated as inches of water column. In some other embodiments, the sensor 154 may be a flow rate sensor, or any other that is adapted to measure a rate of flow of fuel mixture into the combustion chamber 152.

For the embodiments discussed within the scope of the present disclosure, the sensor 154 may be interchangeably referred to as "the pressure sensor 154", and the sensor 154 may indicate pressure in inches of a water column.

The furnace 150 may further include a flame rod sensor 156. The flame rod sensor 156 may be configured to measure a flame current in the combustion chamber 152. The flame current in the combustion chamber 152 is indicative of a flame in the combustion chamber 152. The flame current in the combustion chamber 152 may depend on a ratio of air to fuel in the fuel mixture. An optimal flame current in the combustion chamber 152 may indicate efficient combustion of the fuel mixture with minimum harmful emissions.

In some embodiments, the flame rod sensor 156 may generate an electric current in response to a variation in a flame current, which may be in response to ionization of the fuel mixture. The generated current may be indicative of a temperature state in the combustion chamber 152.

The system 100 may further include an inlet 160 provided with a valve 162. The inlet 160, operable by the valve 162, may be configured to selectively allow air to flow into the combustion chamber 152 of the furnace 150. The inlet 160 may be coupled with a fan 164 to facilitate a forced flow of the air. The fan 164 may facilitate control of a flow rate of the air through the inlet 160.

The system 100 may further include a gas sensor 170 configured downstream of the combustion chamber 152, and configured to measure a level of a first gas in flue gases emanating from the combustion chamber 152. The first gas may be any or a combination of the nitrogen-based oxides, carbon-based oxides, and the volatile organic compounds.

The system 100 further includes a controller 200. The controller 200 may be communicably coupled to the pressure sensor 154, the flame rod sensor 156, the valve 162, the fan 164, and the gas sensor 170. The controller 200 may be configured for calibrating flame current in the furnace 150. The controller 200 may be implemented by way of a single device or a combination of multiple devices that may be communicably coupled or networked together. The controller 200 may be implemented in hardware or a suitable combination of hardware and software. The controller 200 may be a hardware device including a processor executing machine-readable program instructions. The "hardware" may include a combination of discrete components, an integrated circuit, an application-specific integrated circuit, a field programmable gate array, a digital signal processor, or other suitable hardware. The "software" may include one or more objects, agents, threads, lines of code, subroutines, separate software applications, two or more lines of code or other suitable software structures operating in one or more software applications or on one or more processors. The processor may include, for example, without limitations, microprocessors, microcomputers, microcontrollers, digital signal processors, central processing units, state machines, logic circuits, any devices that manipulate data or signals based on operational instructions, and the like. Among other capabilities, the processor may fetch and execute computer-readable instructions in the memory operationally coupled with the controller 200 for performing tasks such as data processing, input/output processing, feature extraction, and/ or any other functions. Any reference to a task in the present disclosure may refer to an operation being or that may be performed on data.

Further, the system 100 may also include other units such as a display unit, an input unit, an output unit, and the like; however, the same are not shown in the FIG. 1, for the purpose of clarity. Also, in FIG. 1, only few units are shown; however, the controller 200 may include multiple such units or the controller 200 may include any such numbers of the units, obvious to a person skilled in the art or as required to implement the features of the present invention.

Conventionally, a flow rate of air in the combustion chamber 152 is maintained by setting a predetermined value of pressure and/or flow rate for the air flow. However, such a methodology may not consider a correlation between the flow rate of air in the combustion chamber 152, and a flame current within the combustion chamber 152. For example, for a set flow rate of air within the combustion chamber 152, there may be fluctuations in the flame current of the combustion chamber 152. This may lead to inefficient combustion, and may increase harmful emissions.

Thus, there is a requirement for a means to dynamically vary a flow rate of air into the combustion chamber in order to maintain an efficient combustion of the fuel mixture during operation of the furnace. Further, there is a requirement for a means to maintain efficient combustion within the combustion chamber that does not require additional components.

Figure 2:
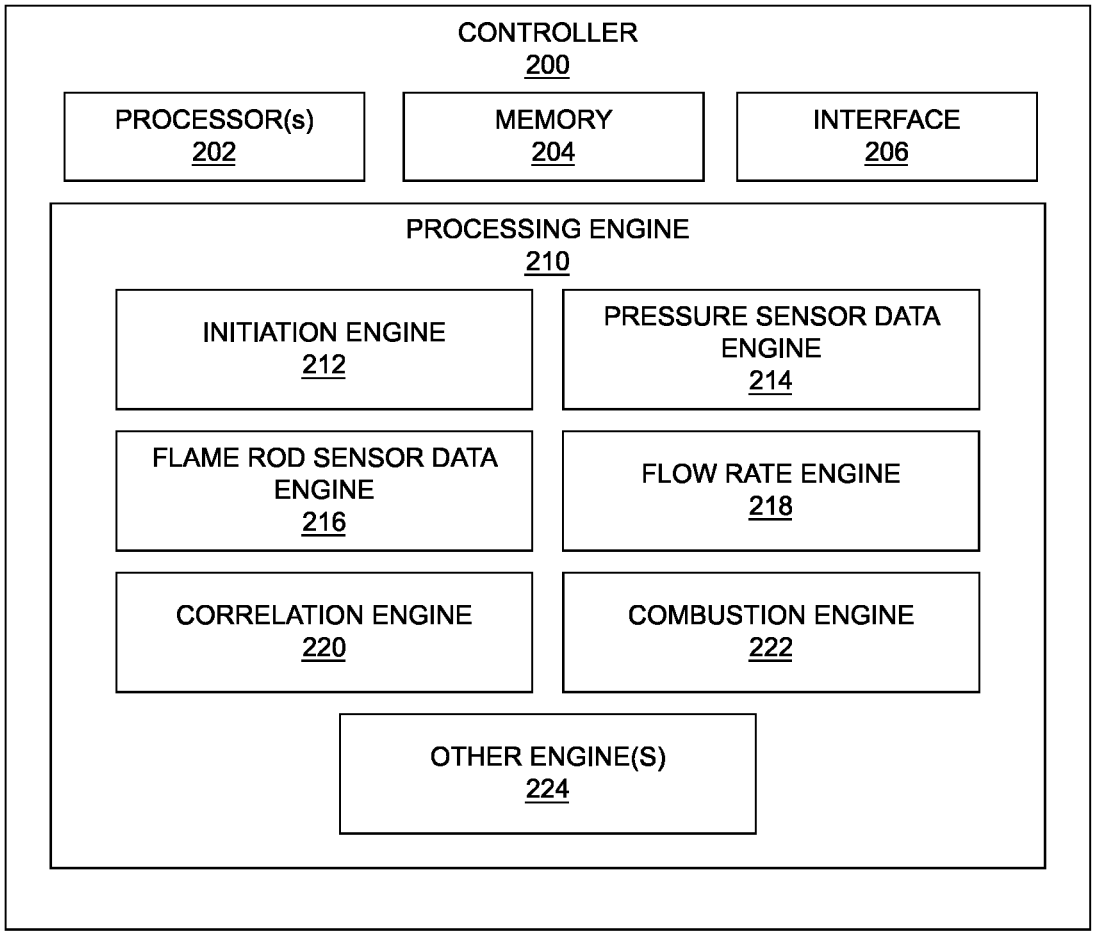
FIG. 2 is a detailed schematic block diagram of a controller of the system of FIG. 1, in accordance with one or more embodiments of the invention.

Referring to FIG. 2, a detailed schematic block diagram of the controller 200 of the system 100 is shown. The controller 200 includes a processor 202, and a memory 204 communicably coupled to the processor 202. The memory 204 may store instructions executable by the processor 202 to implement the controller 200. The controller 200 further includes an interface 206. The interface 206 may include a variety of interfaces, for example, interfaces for data input and output devices, referred to as I/O devices, storage devices, and the like. The interface 206 may also provide a communication pathway for one or more components of the controller 200.

Referring now to FIGS. 1 and 2, the controller 200 includes a processing engine 210. The processing engine 210 may be implemented as a combination of hardware and programming (for example, programmable instructions) to implement one or more functionalities of the processing engine 210. In some examples, the processing engine 210 may be implemented by electronic circuitry.

The processing engine 210 may include an initiation engine 212, a pressure sensor data engine 214, a flame rod sensor data engine 216, a flow rate engine 218, a correlation engine 220, a combustion engine 222, and other engine(s) 224. The other engine(s) 224 may include engines configured to perform one or more functions ancillary functions associated with the processing engine 210.

The initiation engine 212 is configured to initiate combustion within the combustion chamber 152 by allowing flow of the fuel mixture to the combustion chamber 152.

The pressure sensor data engine 214 is configured to receive, from the pressure sensor 154, signals indicative of the flow rate of the air to the combustion chamber. The fuel mixture may initially flow at a default flow rate. In other words, the air may initially flow at the default flow rate to the combustion chamber 152.

The flame rod sensor data engine 216 is configured to receive, from the flame rod sensor 156, signals indicative of the flame current of the combustion chamber 152.

The flow rate engine 218 is configured to vary the flow rate of the air to the combustion chamber 152. In some embodiments, the flow rate engine 218 is configured to vary, responsive to the flame current of the combustion chamber 152 reaching a first value, the flow rate of the air to the combustion chamber 152 to a first flow rate lesser than the default flow rate of the air. In some embodiments, the first flow rate may be zero. In some embodiments, the flow rate engine 218 may operate the valve 162 of the inlet 160 in order to vary the flow rate of air. In some embodiments, the first value of the flame current may be low, indicating a beginning of the combustion of the fuel mixture in the combustion chamber 152. Responsive to the first flow rate of air, the flame current of the combustion chamber 152 may change to a second value greater than the first value. In some embodiments, the second value of flame current of the combustion chamber 152 may be a peak value of the flame current for the combustion chamber 152. Any increase in the flame current beyond the peak value may cause harmonic noise to be generated.

The flow rate engine 218 is further configured to vary, responsive to the flame current of the combustion chamber 152 reaching the second value, the flow rate of the air to the combustion chamber 152 to a second flow rate greater than the first flow rate until the flame current of the combustion chamber 152 reaches a third value lesser than the second value. In some embodiments, the third value may be a predetermined fraction of the second value (or peak allowable value) of flame current for the combustion chamber 152. In some examples, the third value may be about 60% of the second value. In some embodiments, the flow rate engine 218 may increase the flow rate of air to the combustion chamber 152 iteratively, over a plurality of periods of time. In some embodiments, the increase in flow rate of air may be linear or non-linear.

The correlation engine 220 is configured to determine, based on varying of the flow rate of the air to the combustion chamber 152, and the change in the flame current of the combustion chamber 152, a correlation between the flow rate of the air to the combustion chamber 152, and the flame current of the combustion chamber 152.

The combustion engine 222 is configured to maintain the combustion conditions in the combustion chamber 152 at optimum values by varying the flow rate of the air to the combustion chamber 152, such that the flame current of the combustion chamber 152 is substantially at the third value. The third value of flame current may be indicative of conditions in the combustion chamber 152 that allow for efficient combustion of the fuel mixture, and the consequent reduction in emission of harmful gases.

Figure 3:
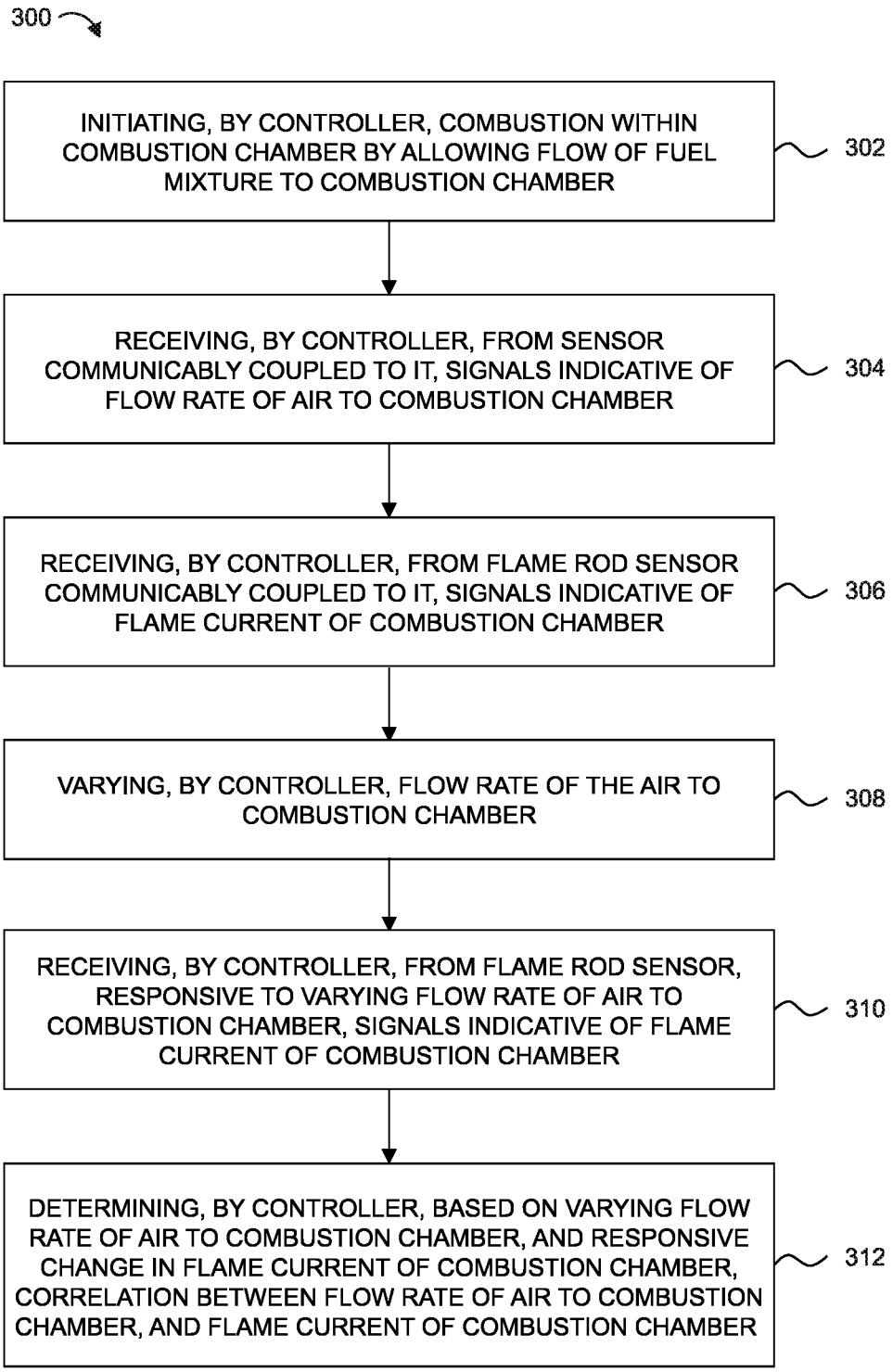
FIG. 3 is a schematic flow diagram for a method for calibrating flame current in the furnace, in accordance with one or more embodiments of the invention.

Referring to FIG. 3, a schematic flow diagram for a method 300 for calibrating flame current in the furnace 150 is shown. Referring now to FIGS. 1 to 3, at step 302, the method 300 includes initiating, by the controller 200, combustion within the combustion chamber 152 by allowing flow of the fuel mixture to the combustion chamber 152. At step 304, the method 300 further includes receiving, by the controller 200, from the pressure sensor 154 communicably coupled to it, signals indicative of a flow rate of the air to the combustion chamber 152. At step 306, the method 300 further includes receiving, by the controller 200, from the flame rod sensor 156 communicably coupled to it, signals indicative of a flame current of the combustion chamber 152. At step 308, the method 300 further includes varying, by the controller 200, the flow rate of the air to the combustion chamber 152. At step 310, the method 300 further includes receiving, by the controller 200, from the flame rod sensor 156, responsive to varying of the flow rate of the air to the combustion chamber 152, signals indicative of a change in the flame current of the combustion chamber 152. At step 312, the method 300 further includes determining, by the controller 200, based on varying of the flow rate of the air to the combustion chamber 152, and the change in the flame current of the combustion chamber 152, the correlation between the flow rate of the air to the combustion chamber 152, and the flame current of the combustion chamber 152.

In some embodiments, the method 300 further includes varying, by the controller 200, responsive to the flame current of the combustion chamber 152 reaching the first value, the flow rate of the air to the combustion chamber 152 to a first flow rate lesser than the default flow rate of the air. Responsive to the first flow rate of air, the flame current of the combustion chamber 152 changes to a second value greater than the first value. The method 300 further includes varying, by the controller 200, responsive to the flame current of the combustion chamber reaching the second value, the flow rate of the air to the combustion chamber 152 to a second flow rate greater than the first flow rate until the flame current of the combustion chamber 152 reaches a third value lesser than the second value.

In some embodiments, the method 300 further includes varying, by the controller 200, the flow rate of the air to the combustion chamber 152, such that the flame current of the combustion chamber 152 is substantially at the third value.

In some embodiments, the method 300 further includes operating, by the controller 200, the valve 162 of the inlet 160 of the furnace 150 to vary the flow rate of the air into the combustion chamber 152.

In some embodiments, the method 300 further includes receiving, by the controller 200, from the gas sensor 170 communicably coupled to it, signals indicative of the quantity of a first gas in a flue gas from the combustion chamber 152. The method 300 further includes varying, by the controller 200, the flow rate of air to the combustion chamber 152, such that the quantity of the first gas in the flue gas from the combustion chamber 152 is lesser than a threshold value.

Figure 4:
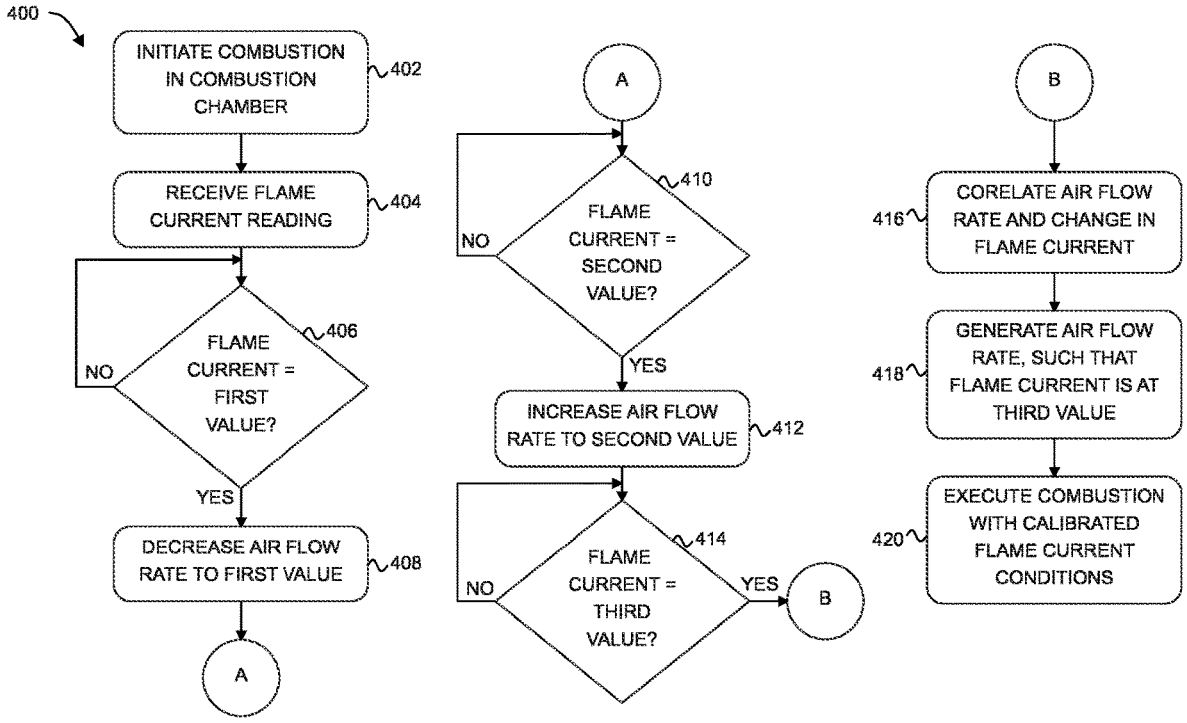
FIG. 4 is an exemplary flow diagram of a process for calibrating flame current in the furnace.

Referring to FIG. 4 an exemplary flow diagram for a process 400 for calibrating flame current in the furnace 150 is shown. In some embodiments, the process 400 may be based on the method 300 described in FIG. 3, and may be implementable by the controller 200 depicted in FIGS. 1 and 2. The process 400 may be a computer implementable process and may be executed by the processor 202 of the controller 200 based on instructions stored in the memory 204.

Referring now to FIGS. 1 to 4, at step 402, the process 400 includes initiating combustion in the combustion chamber 152 of the furnace 150. At step 404, the process 400 includes receiving a flame current reading of the combustion chamber 152, from the flame rod sensor 156. At step 406, the process 400 includes checking if the flame current has reached the first value. If the flame current has not reached the first value, the process 400 includes subsequent checking of the flame current reading. If the flame current has reached the first value, the process 400 proceeds to step 408 including decreasing the air flow rate to the combustion chamber 152 to the first value. At step 410, the process 400 includes checking if the flame current has reached the second value. If the flame current has not reached the second value, the process 400 includes subsequent checking of the flame current reading. If the flame current has reached the second value, the process 400 proceeds to step 412 including increasing the air flow rate to the combustion chamber 152 to the second value. At step 414, the process 400 includes checking if the flame current has reached the third value. If the flame current has not reached the third value, the process 400 includes subsequent checking of the flame current reading. If the flame current has reached the third value, the process 400 proceeds to step 416 including correlating the air flow rate and responsive change in flame current reading. At step 418, the process 400 includes generating and maintaining an air flow rate such that the flame current reading is at the third value. In some embodiments, the third value may be a predetermined fraction of the second value. at step 420, the process 400 includes executing combustion of the fuel mixture within the combustion chamber 152 with the calibrated flame current conditions.

Figure 5:
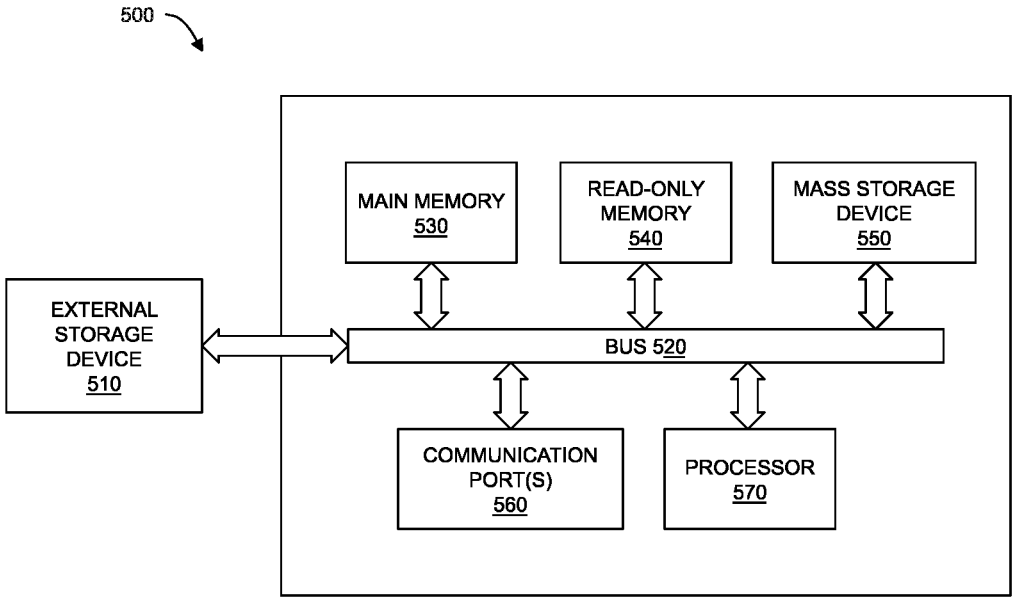
FIG. 5 is an exemplary schematic block diagram of a hardware system used for implementing the cloud server of FIG. 2.

FIG. 5 is an exemplary schematic block diagram of a hardware system used for implementing the controller 200. As shown in FIG. 5, a computer system 500 can include an external storage device 510, a bus 520, a main memory 530, a read only memory 540, a mass storage device 550, communication port 560, and a processor 570. A person skilled in the art will appreciate that the computer system may include more than one processor and communication ports. Examples of processor 570 include, but are not limited to, an Intel® Itanium® or Itanium 2 processor(s), or AMD® Opteron® or Athlon MP® processor(s), Motorola® lines of processors, FortiSOC™ system on chip processors or other future processors. Processor 570 may include various modules. Communication port 560 can be any of an RS-232 port for use with a modem-based dialup connection, a 10/100 Ethernet port, a Gigabit or 10 Gigabit port using copper or fibre, a serial port, a parallel port, or other existing or future ports. Communication port 560 may be chosen depending on a network, such a Local Area Network (LAN), Wide Area Network (WAN), or any network to which computer system connects. Memory 530 can be Random Access Memory (RAM), or any other dynamic storage device commonly known in the art. Read-only memory 540 can be any static storage device(s) e.g., but not limited to, a Programmable Read Only Memory (PROM) chips for storing static information e.g., start-up or BIOS instructions for processor 570. Mass storage 550 may be any current or future mass storage solution, which can be used to store information and/or instructions. Exemplary mass storage solutions include, but are not limited to, Parallel Advanced Technology Attachment (PATA) or Serial Advanced Technology Attachment (SATA) hard disk drives or solid-state drives (internal or external, e.g., having Universal Serial Bus (USB) and/or Firewire interfaces), e.g. those available from Seagate (e.g., the Seagate Barracuda 7102 family) or Hitachi (e.g., the Hitachi Deskstar 7K1000), one or more optical discs, Redundant Array of Independent Disks (RAID) storage, e.g. an array of disks (e.g., SATA arrays), available from various vendors including Dot Hill Systems Corp., LaCie, Nexsan Technologies, Inc. and Enhance Technology, Inc.

Bus 520 communicatively couples processor(s) 570 with the other memory, storage, and communication blocks. Bus 520 can be, e.g., a Peripheral Component Interconnect (PCI)/PCI Extended (PCI-X) bus, Small Computer System Interface (SCSI), USB or the like, for connecting expansion cards, drives and other subsystems as well as other buses, such a front side bus (FSB), which connects processor 570 to software system.

Optionally, operator and administrative interfaces, e.g., a display, keyboard, and a cursor control device, may also be coupled to bus 520 to support direct operator interaction with a computer system. Other operator and administrative interfaces can be provided through network connections connected through communication port 560. The external storage device 510 can be any kind of external hard-drives, floppy drives, IOMEGA® Zip Drives, Compact Disc-Read Only Memory (CD-ROM), Compact Disc-Re-Writable (CD-RW), Digital Video Disk-Read Only Memory (DVD-ROM). Components described above are meant only to exemplify various possibilities. In no way should the aforementioned exemplary computer system limit the scope of the present disclosure.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A method for calibrating flame current in a furnace, the method comprising:

initiating, by a controller, combustion within a combustion chamber by allowing flow of a fuel mixture to the combustion chamber, wherein the combustion chamber is configured in the furnace and adapted for burning the fuel mixture comprising fuel and air;

receiving, by the controller, from a sensor communicably coupled to it, signals indicative of a flow rate of the air to the combustion chamber, wherein the sensor is configured in the furnace and is configured to generate signals indicative of a flow rate of the fuel mixture into the combustion chamber, and wherein for a fixed flow rate of the fuel, the generated signals are indicative of a flow rate of the air;

receiving, by the controller, from a flame rod sensor communicably coupled to it, signals indicative of a flame current of the combustion chamber, wherein the flame rod sensor is configured in the combustion chamber, and is configured to generate signals indicative of a flame current in the combustion chamber;

varying, by the controller, a flow rate of the air to the combustion chamber;

receiving, by the controller, from the flame rod sensor, responsive to varying of the flow rate of the air to the combustion chamber, signals indicative of a change in the flame current of the combustion chamber; and determining, by the controller, based on varying of the flow rate of the air to the combustion chamber, and the change in the flame current of the combustion chamber, a correlation between the flow rate of the air to the combustion chamber, and the flame current of the combustion chamber; and varying, by the controller, responsive to the flame current of the combustion chamber reaching a first value, the flow rate of the air to the combustion chamber to a first flow rate lesser than a default flow rate of the air, wherein, responsive to the first flow rate of air, the flame current of the combustion chamber changes to a second value greater than the first value.

2. The method of claim 1, further comprising:

varying, by the controller, responsive to the flame current of the combustion chamber reaching the second value, the flow rate of the air to the combustion chamber to a second flow rate greater than the first flow rate until the flame current of the combustion chamber reaches a third value lesser than the second value.

3. The method of claim 1, wherein the second value of flame current of the combustion chamber is a peak value of the flame current for the combustion chamber.

4. The method of claim 2, wherein the third value of flame current of the combustion chamber is a predetermined fraction of the second value of flame current of the combustion chamber.

5. The method of claim 2, further comprising varying, by the controller, the flow rate of the air to the combustion chamber such that the flame current of the combustion chamber is substantially at the third value.

6. The method of claim 1, further comprising operating, by the controller, a valve of an inlet of the furnace to vary the flow rate of the air into the combustion chamber, wherein the inlet is adapted to allow inflow of the air into the furnace, and the inlet is operable by the valve.

7. The method of claim 1, further comprising: receiving, by the controller, from a gas sensor communicably coupled to it, signals indicative of a quantity of a first gas in a flue gas from the combustion chamber, wherein the gas sensor is configured downstream of the combustion chamber, and is configured to generate signals indicative of a quantity of the first gas in the flue gas from the combustion chamber; and varying, by the controller, the flow rate of air to the combustion chamber, such that the quantity of the first gas in the flue gas from the combustion chamber is lesser than a threshold value.

8. The method of claim 7, wherein the first gas comprises any one or a combination of nitrogen-based oxides, carbon-based oxides, and volatile organic compounds.

9. A system for calibrating flame current in a furnace, the system comprising: a combustion chamber configured in the furnace, the combustion chamber adapted for burning a fuel mixture comprising fuel and air;

a sensor configured in the furnace, the sensor configured to generate signals indicative of a flow rate of the fuel mixture into the combustion chamber, wherein for a fixed flow rate of the fuel, the generated signals are indicative of a flow rate of the air;

a flame rod sensor configured in the combustion chamber, the flame rod sensor configured to generate signals indicative of a flame current in the combustion chamber; and a controller communicably coupled to the flame rod sensor and the sensor, the controller configured to:

initiate combustion within the combustion chamber by allowing flow of the fuel mixture to the combustion chamber;

receive, from the sensor, signals indicative of a flow rate of the air to the combustion chamber;

receive, from the flame rod sensor, signals indicative of a flame current of the combustion chamber;

vary a flow rate of the air to the combustion chamber;

receive, from the flame rod sensor, responsive to varying of the flow rate of the air to the combustion chamber, signals indicative of a change in the flame current of the combustion chamber; and determine, based on varying of the flow rate of the air to the combustion chamber, and the change in the flame current of the combustion chamber, a correlation between the flow rate of the air to the combustion chamber, and the flame current of the combustion chamber; and vary, responsive to the flame current of the combustion chamber reaching a first value, the flow rate of the air to the combustion chamber to a first flow rate lesser than a default flow rate of the air, wherein, responsive to the first flow rate of air, the flame current of the combustion chamber changes to a second value greater than the first value.

10. The system of claim 9, wherein the controller is further configured to:

vary, responsive to the flame current of the combustion chamber reaching the second value, the flow rate of the air to the combustion chamber to a second flow rate greater than the first flow rate until the flame current of the combustion chamber reaches a third value lesser than the second value.

11. The system of claim 9, wherein the second value of flame current of the combustion chamber is a peak value of the flame current for the combustion chamber.

12. The system of claim 10, wherein the third value of flame current of the combustion chamber is a predetermined fraction of the second value of flame current of the combustion chamber.

13. The system of claim 10, wherein the controller is further configured to vary the flow rate of the air to the combustion chamber such that the flame current of the combustion chamber is substantially at the third value.

14. The system of claim 9, further comprising an inlet adapted to allow inflow of the air into the furnace, the inlet operable by a valve communicably coupled to the controller, wherein the controller is configured to operate the valve to vary the flow rate of the air into the combustion chamber.

15. The system of claim 14, further comprising a fan coupled to the inlet, the fan communicably coupled to the controller, wherein the controller is configured to operate the fan to control the flow rate of the air into the combustion chamber.

16. The system of claim 9, further comprising a gas sensor configured downstream of the combustion chamber, the gas sensor communicably coupled to the controller and configured to generate signals indicative of a quantity of a first gas in a flue gas from the combustion chamber.

17. The system of claim 16, wherein the controller is further configured to: receive, from the gas sensor, signals indicative of the quantity of the first gas in the flue gas from the combustion chamber; and vary the flow rate of air to the combustion chamber such that the quantity of the first gas in the flue gas from the combustion chamber is less than a threshold value.

18. The system of claim 9, wherein the first gas comprises any or a combination of nitrogen-based oxides, carbon-based oxides, and volatile organic compounds.

19. The system of claim 9, wherein the flame rod sensor comprises a flame rod, and wherein the signals generated by the flame rod comprises an electric current.

20. The system of claim 9, wherein the sensor comprises a pressure sensor, and wherein the sensor is configured to indicate the flow rate of air in terms of inches of a water column.

* * * * *